US007323437B2

(12) United States Patent
Fujinami et al.

(10) Patent No.: US 7,323,437 B2
(45) Date of Patent: Jan. 29, 2008

(54) PROCESS FOR PRODUCING A BLEACHING ACTIVATOR COMPOSITION

(75) Inventors: Shigeaki Fujinami, Wakayama (JP); Hiroshi Noro, Wakayama (JP); Masakazu Furukawa, Wakayama (JP); Hiroyuki Yamashita, Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 11/017,742

(22) Filed: Dec. 22, 2004

(65) Prior Publication Data

US 2005/0170984 A1 Aug. 4, 2005

(30) Foreign Application Priority Data

Dec. 25, 2003 (JP) ..... 2003-429558

(51) Int. Cl.

| | |
|---|---|
| ***C11D 1/00*** | (2006.01) |
| ***C11D 3/20*** | (2006.01) |
| ***C11D 3/26*** | (2006.01) |
| ***C11D 3/395*** | (2006.01) |

(52) U.S. Cl. ..... 510/376; 510/311; 510/312; 510/313; 510/499; 510/505

(58) Field of Classification Search ..... None
See application file for complete search history.

(56) References Cited

U.S. PATENT DOCUMENTS

| | | | | |
|---|---|---|---|---|
| 4,486,327 | A | 12/1984 | Murphy et al. | |
| 5,002,691 | A | 3/1991 | Bolkan et al. | |
| 5,458,801 | A * | 10/1995 | Oyashiki et al. | 252/186.25 |
| 5,534,196 | A * | 7/1996 | Chapman et al. | 252/186.27 |
| 5,814,242 | A * | 9/1998 | Alvarez et al. | 252/186.39 |
| 6,451,753 | B2 * | 9/2002 | Oetter et al. | 510/376 |

FOREIGN PATENT DOCUMENTS

| | | | |
|---|---|---|---|
| DE | 3128336 | A1 | 9/1997 |
| DE | 19609953 | A1 | 9/1997 |
| EP | 0462723 | A1 | 12/1991 |
| JP | 2001-59099 | A | 3/2001 |

* cited by examiner

*Primary Examiner*—Gregory R. Del Cotto
(74) *Attorney, Agent, or Firm*—Birch, Stewart, Kolasch & Birch, LLP

(57) ABSTRACT

The invention provides a process for producing a bleaching activator composition, which includes removing a solvent and/or water from a mixture of a bleaching activator and a surfactant dispersed in a non-aqueous solvent, a bleaching activator composition produced by the process and a bleaching activator granule obtained by further granulating the bleaching activator composition.

12 Claims, No Drawings

PROCESS FOR PRODUCING A BLEACHING ACTIVATOR COMPOSITION

FIELD OF THE INVENTION

The present invention relates to a process for producing a bleaching activator composition, a bleaching activator composition obtained by the process and a bleaching activator granule obtained by further granulating the bleaching activator composition.

BACKGROUND OF THE INVENTION

Conventionally, various bleaching activators have been proposed to increase the bleaching power of oxygen-based bleaching agents such as sodium percarbonate, sodium perborate, etc. Their functions may be significantly deteriorated due to interaction with the oxygen-based bleaching agents during storage or with other components contained in a detergent. Accordingly, the bleaching activator is required to have high shelf stability. Further, the bleaching activator is required to have an excellent solubility even under conditions of washing with a weak stirring force in cold water or under conditions of bleaching by dipping.

JP-A 2001-59099 discloses bleaching activator granules excellent in solubility, wherein a bleaching activator, a nonionic surfactant having a melting point of lower than 20° C. satisfying specific dissolution conditions, and at least one nonionic surfactant selected from alkylene oxide-added nonionic surfactants having a melting point of lower than 20° C. are contained in a specific ratio.

SUMMARY OF THE INVENTION

The present invention provides a process for producing a bleaching activator composition by removing a solvent and/or water from a mixture of a bleaching activator and a surfactant dispersed in a non-aqueous solvent, a bleaching activator composition obtained by the process and a bleaching activator granule obtained by further granulating the bleaching activator composition.

DETAILED DESCRIPTION OF THE INVENTION

In recent years, however, the stirring force under washing conditions is low and the washing time is reduced, and thus there is demand for a bleaching activator composition showing a high rate of dissolution.

The present invention provides a bleaching activator composition excellent in solubility and a process for producing the same.

According to the process of the present invention, a bleaching activator composition or a bleaching activator granule (hereinafter referred to as a bleaching activator composition), being excellent in solubility, can be produced, and the bleaching activator composition of the present invention can be used preferably under conditions of washing clothing with a low stirring force for a reduced washing time.

[Bleaching Activator]

The bleaching activator used in the present invention is not particularly limited insofar as the bleaching power of a bleaching agent can be increased, and examples include tetraacetyl ethylene diamine, glucose pentaacetate, tetraacetyl glycoluril, alkanoyl or alkenoyl (number of carbon atoms in this group is 8 to 14) oxybenzene carboxylic acid or salts thereof, and alkanoyl or alkenoyl (number of carbon atoms in this group is 8 to 14) oxybenzene sulfonates, among which at least one member selected from alkanoyl or alkenoyl (number of carbon atoms in this group is 8 to 14, preferably 10 to 14, with respect to the bleaching effect) oxybenzene carboxylic acid or salts thereof and alkanoyl or alkenoyl (number of carbon atoms in this group is 8 to 14, preferably 10 to 14, with respect to the bleaching effect) oxybenzene sulfonates is preferable from the viewpoint of solubility. Particularly, decanoyl oxybenzene carboxylic acid or a sodium salt thereof, or sodium dodecanoyl oxybenzene sulfonate, is preferable.

[Surfactant]

The surfactant used in the present invention includes anionic surfactants, nonionic surfactants, amphoteric surfactants, and cationic surfactants, and a combination of a nonionic surfactant and an anionic surfactant is preferably used.

The anionic surfactant used in the present invention includes alkyl sulfates, polyoxyalkylene alkyl ether sulfates, alkyl benzene sulfonates, olefin sulfonates, alkane sulfonates, saturated or unsaturated fatty acid salts, alkyl or alkenyl ether carboxylates, α-sulfofatty acid salts, and α-sulfofatty esters, among which alkyl sulfates, polyoxyalkylene alkyl ether sulfates and alkyl benzene sulfonates are more preferable.

The alkyl sulfates include, for example, compounds represented by formula (I):

$$[R^1—SO_3]_pM^1 \quad (I)$$

wherein $R^1$ represents a C8 to C20 linear alkyl group, $M^1$ represents a cation, and p represents the valence of $M^1$.

In formula (I), $R^1$ is preferably a C10 to C18 alkyl group from the viewpoint of solubility. $M^1$ is preferably an alkali metal such as Na, K etc., an alkaline earth metal such as Ca, Mg etc., or an alkanol-substituted or unsubstituted ammonium group, more preferably an alkali metal, even more preferably Na. p represents the valence of $M^1$ and is preferably 1 or 2, more preferably 1.

The polyoxyalkylene alkyl ether sulfates include, for example, compounds represented by formula (II):

$$[R^2—O(AO)_n—SO_3]_qM^2 \quad (II)$$

wherein $R^2$ represents a C8 to C20 linear alkyl group, AO represents a C2 to C4 oxyalkylene group, AOs whose number is n may be the same or different, n is a number of 0.05 to 5 representing the number of alkylene oxide molecules added on average, $M^2$ represents a cation, and q represents the valence of $M^2$, and is preferably 1 or 2, more preferably 1.

In formula (II), $R^2$ is preferably a C10 to C18 alkyl group from the viewpoint of solubility. AO is preferably a C2 to C3, more preferably C2, oxyalkylene group. n is preferably a number of 0.1 to 3, more preferably 0.2 to 2. $M^2$ is an alkali metal such as Na, K, etc., an alkaline earth metal such as Ca, Mg, etc., or an alkanol-substituted or unsubstituted ammonium group, more preferably an alkali metal, even more preferably Na. p is preferably 1 or 2, more preferably 1.

The distribution of added alkylene oxides in the polyoxyalkylene alkyl ether sulfate is not particularly limited, and may be either generally so-called broad or narrow distribution.

From the viewpoint of solubility, the alkyl benzene sulfonate is preferably the one having a C8 to C20 alkyl group, more preferably a sodium salt or potassium salt.

The anionic surfactants mentioned above may be used alone or as a mixture of two or more thereof. For example, mention is made of simultaneous use of two surfactants i.e. alkyl sulfate and polyoxyalkylene alkyl ether sulfate and simultaneous use of three surfactants i.e. alkyl sulfate, polyoxyalkylene alkyl ether sulfate and alkyl benzene sulfonate.

The nonionic surfactant used in the present invention includes alkylene oxide-added nonionic surfactants, higher fatty acid alkanol amides or alkylene oxide adducts thereof, sucrose fatty esters, alkyl glucosides etc. From the viewpoint of solubility, the nonionic surfactant is an oxide alkylene-added nonionic surfactant having a melting point of lower than 20° C., preferably at least one member selected from oxide ethylene- and/or propylene oxide-added nonionic surfactants, more preferably a member selected from nonionic surfactants represented by formula (III):

$$R^3O—(PO)_r—(EO)_a—H \quad (III)$$

wherein $R^3$ represents a C10 to C18, preferably C10 to C14, alkyl or alkenyl group, r and s independently represent a number of 0 to 20, preferably 1 to 10, more preferably 2 to 10, provided that r+s is 1 or more, PO is a propylene oxy group, EO is an ethylene oxy group, and PO and EO may be added in block or at random.

Among these nonionic surfactants, those represented by formula (III-1) are preferable with respect to the bleaching effect.

$$R^3O—(EO)_t—(PO)_u—(EO)_n—H \quad (III\text{-}1)$$

wherein $R^3$, EO and PO have the same meaning as defined above, t is 0 to 10, preferably 1 to 7, u is 1 to 10, preferably 1 to 5, and v is 0 to 10, preferably 1 to 7, provided that t and v are not simultaneously 0.

Specific examples of the ionic surfactants represented by formula (III-1) include Emulgen KS-108 (adduct of C12 alcohol/5 moles of EO/2 moles of PO/3 moles of EO) and Emulgen LS-106 (adduct of C12 alcohol/2.5 moles of EO/1.5 moles of PO/3 moles of EO) manufactured by Kao Corporation.

When a liquid surfactant is used from the viewpoint of physical properties of powder prepared by removing a solvent from a mixture of the bleaching activator and the surfactant, the liquid surfactant is used preferably as a mixture with a surfactant paste such as an anionic surfactant.

The amphoteric surfactant preferably used in the present invention includes amine oxides, sulfobetaine, carbobetaine, etc.

The cationic surfactant preferably used in the present invention includes quaternary ammonium salts, amine salts, etc.

In the present invention, the surfactant is used preferably in a liquid or paste form because upon preparing a mixture thereof with a bleaching activator, a mixture wherein the bleaching activator is uniformly dispersed can be easily obtained. When the bleaching activator composition is to be obtained as granules, the surfactant is used more preferably in a paste form.

[Non-Aqueous Solvent]

The non-aqueous solvent used in the present invention may be a solvent in which the bleaching activator is substantially insoluble, and the type of solvent is not particularly limited. For example, hydrocarbons, ketones, alcohols and ethers are preferably used. Among these solvents, toluene, xylene, benzene, hexane, octane, acetone, ethyl alcohol, isopropyl alcohol, diethyl ether etc. are preferable.

When water in which the bleaching activator is dissolved is used, the bleaching activator is hydrolyzed to reduce the active ingredient, and thus the aqueous solvent is not preferable.

Process for Producing the Bleaching Activator Composition

The process of the present invention includes a step of mixing a bleaching activator and a surfactant dispersed in a non-aqueous solvent to give a mixture (referred to hereinafter as step 1) and a step of removing the solvent and/or water from the mixture obtained in step 1 to give a bleaching activator composition (referred to hereinafter as step 2).

In step 1, the order of addition of the bleaching activator and the surfactant to the non-aqueous solvent is not limited insofar as the bleaching activator can be prevented from being aggregated, but for preventing aggregation of the bleaching activator, it is preferable that the bleaching activator is first dispersed in the non-aqueous solvent in which the bleaching activator is substantially insoluble, and then uniformly dispersed/mixed with the surfactant.

The method of dispersing the bleaching activator is not particularly limited, and there is a method of preparing a bleaching activator dispersion by charging a stirring mixing bath with a non-aqueous solvent in which the bleaching activator is insoluble, and then feeding the bleaching activator, while stirring, to the stirring mixing bath. When the solids content of the bleaching activator dispersion is low, the dispersion has low viscosity and can be easily handled, but with a too low solids content given, the burden on step 2 as a post-step is increased, while when the solids content is too high, the viscosity is increased to deteriorate handling, and therefore the solids content is preferably 20 to 80% by weight, more preferably 40 to 60% by weight.

When there is a state of the bleaching activator dispersed in a non-aqueous solvent in steps such as a purification step, etc. after reaction of the synthesis of the bleaching activator, such bleaching activator dispersion may be used.

The means of mixing the bleaching activator and surfactant dispersed in a non-aqueous solvent is not particularly limited insofar as the bleaching activator can be uniformly dispersed/mixed with the surfactant while the bleaching activator is prevented from being aggregated, and a general batch stirring mixing bath, a continuous mixer, etc. can be used. The batch stirring mixing bath includes, for example, a stirring mixing bath, a batch kneader manufactured by Satake Kagaku Kikai Kogyo Co., Ltd. and Nautor Mixer manufactured by Hosokawa Micron Co., Ltd., and the continuous mixer includes, for example, a static mixer manufactured by Noritake Company and KRC kneader manufactured by Kurimoto Tekkosho Co., Ltd.

The temperature in mixing is preferably a temperature at which the solvent does not boil at ordinary temperatures, and the temperature is preferably lower to prevent decomposition of the bleaching activator, but when the temperature is too low, the fluidity of the mixture is lowered, thus making uniform dispersion/mixing difficult, and thus the temperature is preferably 10 to 80° C., more preferably 30 to 60° C.

The mixing ratio of the bleaching activator to the surfactant by weight (bleaching activator/surfactant) is preferably 100/30 to 100/5, more preferably 100/15 to 100/10.

The solids content of the mixture of the bleaching activator and the surfactant is preferably 80% by weight or less in which the mixture is in a fluidized state at ordinary temperatures, more preferably 50 to 80% by weight in which the burden of removing the solvent and water in step 2 is reduced. A solids content of 80% by weight or less is preferable because suitable fluidity can be secured.

Step 2 is a step of removing the solvent and/or water from the mixture of the bleaching activator and the surfactant in a non-aqueous solvent, prepared in step 1, under various conditions, and removal of the solvent and water may occur simultaneously with granulation. The percentage of the solvent and/or water remaining in the bleaching activator composition after removal of the solvent and/or water is preferably 10% by weight or less, more preferably 5% by weight or less.

The means of removal is preferably drying, and drying under vacuum is preferable in order to prevent the decomposition of the bleaching activator by heating, the deterioration of qualities by hydrolysis, etc., and in this case, drying is carried out preferably at the degree of vacuum at which the temperature for removing the non-aqueous solvent and water is reduced to 80° C. or less thereby reducing heat history and preventing the deterioration of qualities by decomposition. In consideration of milling at the end of drying, a continuous or batch vacuum drying machine having a stirring blade and a pulverizer, or a drying process achieving an effect equivalent thereto, is preferable.

The continuous drying machine includes, for example, rotating thin-film evaporators such as Contro, Sebcon [manufactured by Hitachi, Ltd.], Smith thin-film evaporator [manufactured by Shinko Pantec], etc. In such continuous drying machine, a mixture of the bleaching activator and surfactant in a non-aqueous solvent can be introduced continuously into a rotating thin-film evaporator under reduced pressure to give a dried product. The drying machine having a depressurizing function includes SV mixer manufactured by Shinko Pantec, a batch kneader manufactured by Satake Kagaku Kikai Kogyo Co., Ltd., a Nautor mixer manufactured by Hosokawa Micron Co., Ltd., a high-speed mixer manufactured by Fukae Powtec Co., Ltd., Henschel mixer manufactured by Mitsui Mining Co., Ltd., Super mixer manufactured by Kawada Seisakusho Co., Ltd., a mixing drying machine manufactured by Tanabe Willtec Inc., a vertical granulator manufactured by Powrex, etc. Particularly when the batch system is used, the high-speed mixer, vertical granulator, Henschel mixer or Super mixer is preferable because the burden on facilities is low and a granulated product having a uniform particle size can be obtained by removing the non-aqueous solvent and water and simultaneously adding a mixture of the bleaching activator and the surfactant in a non-aqueous solvent to the powdery material in a fluidized state.

In a more preferable drying method, the powder of the bleaching activator and/or powder other than the bleaching activator are incorporated as a powdery material into a batch vacuum drying machine having a stirring blade and/or a pulverizer to such a degree as to attain stirring and pulverizing effects. Then a mixture of the bleaching activator and the surfactant in a non-aqueous solvent is fed at such a feed rate as to maintain the powdery material in a powdery state under reduced pressure in the machine and then dried to give a more preferable dried product having a uniform particle size. The previously charged powdery material is shown below.

The previously charged powdery material is preferably powders containing the bleaching activator. The reason for this is that the content of the bleaching activator in the resulting bleaching activator composition is increased, and the performance (bleaching ability, degree of formation of peracid, etc.) of the bleaching activator composition per unit weight is also increased. From the viewpoint of solubility, the powders of the bleaching activator are preferably those having an average particle diameter of 0.1 to 50 μm, more preferably 0.5 to 20 μm, even more preferably 1 to 10 μm. The amount of the powdery material added is preferably 10 to 30% by weight based on the total amount of the composition.

For the purpose of regulating the particle size, powders other than the bleaching activator may also be used as the powdery material. The powders other than the bleaching activator include Glauber's salt, sodium carbonate, sodium bicarbonate, etc. The amount of these powders added is preferably 10 to 30% by weight based on the total amount of the composition. From the viewpoint of granulation, the average particle diameter is preferably 10 to 200 μm, more preferably 50 to 100 μm.

To regulate the particle size, the granulating method is not particularly limited, but a desired granule can be obtained by (1) a stirring rotating granulation method, (2) a fluid-bed granulation method, (3) an extrusion granulation method and (4) a compressing granulation method such as tabletting, briquetting or compacting.

The binder used for granulation is not particularly limited, but water or a water-soluble binder may be used singly or as a mixture of two or more kinds. The water-soluble binder includes, for example, polyethylene glycol, polypropylene glycol, polyoxyethylene-polyoxypropylene glycol, carboxymethyl cellulose, polyvinyl alcohol, polyvinyl pyrrolidone, a water-soluble cellulose derivative (for example an ether compound thereof), a carboxylic acid polymer, a polyoxyethylene (added moles of ethylene oxide=3~300), alkyl (C8-22) ether, a polyoxyethylene (added moles of ethylene oxide=10~300)alkyl(C8-14) phenol ether, a sucrose ester, an alkyl glycoside, an anionic surfactant of a carboxylic acid compound, a sulfonic acid compound, a sulfuric ester compound or a phosphonic ester compound, an ampholytic surfactant, a polyoxyethylene alkylamine, a fatty acid monoethanol amide, a fatty acid diethanol amide, a fatty acid glyceride having C8 to C20, starch, starch-hydrolyzed product, sugars and derivatives thereof.

The granulation methods are described in detail.

(1) stirring Rotating Granulation Method

The stirring rotating granulation method can be conducted by adding a liquid or solid binder to a bleaching activator composition introduced in a tank, while optionally heating or cooling, while optionally rotating stirring blades, to effect granulation. According to the present method, it is possible to control solubility of the obtained granulation product by controlling the kind and amount of the binder or the granulation time. The granulation may be carried out either batch-wise or continuously.

The binder may be added one time. In order to obtain a desired granulation product or take properties of the binder into account, alternatively it may be added with changed addition timing or intermittently. Among the water-soluble binders, polyethylene glycol and polypropylene glycol, having a molecular weight of 400 to 20,000, preferably 600 to 10,000, are preferable for easy control of granulation or storage stability of the granulation product. A liquid binder may be added preferably by spraying. The amount of the binder is not specifically limited, but it is preferably 5 to 40% by weight, more preferably 10 to 20% by weight of the bleaching activator composition from the viewpoint of productivity.

The granulator is not specifically limited, but includes:

(i) a mixer such that a mixing tank is provided inside with a stirring shaft with stirring blades to mix powder, for example Henschel Mixer (manufactured by Mitsui Miike Kakouki Co., Ltd.), Hi-speed Mixer (manufactured by Fukae Kogyo Co., Ltd.), Vertical Granulator (manufactured by Powlek Co., Ltd.), Loedige Mixer (manufactured by Matsuzaka Giken Co., Ltd.), Proshear Mixer (manufactured by Taiheiyo Kikou Co., Ltd.), etc.;

(ii) a mixer such that a ribbon-like wing having a spiral form is rotated in a fixed container, being tube or semi-tube in shape, to conduct mixing, for example Ribbon Mixer (manufactured by Hiwa Kikai Kogyo Co., Ltd.), Batch Kneader (manufaxtured by Satake Kagaku Kikai Kogyo Co., Ltd.) etc.;

(iii) a mixer such that a screw is rotated, in a conical container, around a parallel axis to the wall of the container and on its axis, for example Nautor Mixer (manufactured by Hosokawa Micron Co., Ltd.), etc.

After granulation, drying, coating or sieving may be optionally conducted.

(2) Fluid-Bed Granulation Method

The fluid-bed granulation method can be conducted by holding a bleaching activator composition in a fluidized state with a fluid introduced from the bottom of the equipment and adding a liquid binder to the fluid-bed to effect condensation and granulation. The binder may be added one time. In order to obtain a desired granulation product or take properties of the binder into account, alternatively it may be added with changed addition timing or intermittently.

To obtain a uniform granulated product, the binder is preferably added by spraying. The amount of the binder is not specifically limited. It, however, is preferably 5 to 40% by weight, more preferably 10 to 20% by weight, by weight of the bleaching activator composition, from the viewpoint of productivity.

A preferable fluid-bed granulator is Flow Coater (manufactured by Freund Corporation), Spir-a-flow (manufactured by Freund Corporation), Aglomaster (manufactured by Hosokawa Micron Co., Ltd.) and Glow Max (manufactured by Fuji Paudal Co., Ltd.), etc.

After granulation, drying, coating and sieving may be optionally conducted.

(3) Extrusion Granulation Method

The extrusion granulation method can be conducted by adding the above mentioned binder to a bleaching activator composition and blending them to impart plasticity and molding granules with a die having many holes in an extrusion system or pressing the blend against a screen member to extrude granules from holes to obtain granules having an average size of 0.3~30 mm and a uniform size.

Granulation with a thermoplastic binder may be conducted by extrusion under conditions that the binder exhibits its thermoplastic property by heating. The binder is preferably mixed in advance with a Nautor Mixer etc. Moreover the granules obtained by the above shown fluid-bed granulation method may be extruded to obtain granules. The amount of the binder is not specifically limited. It, however, is preferably 5 to 40% by weight, more preferably 10 to 20% by weight, by weight of the bleaching activator composition, from the viewpoint of productivity. The binder is preferably polyethylene glycol or polypropylene glycol, having a molecular weight of 400 to 20,000, preferably 600 to 10,000, for easy control of granulation or storage stability of the granulation product.

A preferable extrusion granulator is Pelleter Double (manufactured by Fuji Paudal Co., Ltd.), Twindomegran (manufactured by Fuji Paudal Co., Ltd.), etc. After granulation, post-pulverization, rounding finish and sieving may be optionally conducted. Further the particle diameter thereof may be adjusted.

(4) Tableting/Briquetting/Compacting

Tabletting, briqueting and compacting are each a pressing granulation method, providing only a small amount of mine dust, suitable to obtain a granulation product of the bleaching activator composition having a uniformly sized grain.

Tabletting is a granulation method by charging a mold with a bleaching activator composition and pressing it with a pounder. In a roll-pressing method to press a bleaching activator composition with two rotating rolls and mold it, one case where rollers are carved in a mold is briquetting and the other with no carved mold is compacting. In the pressing granulation method, a very high pressure such as 0.2 to 5 ton/cm$^2$ can be applied to the bleaching activator composition and therefore granulation without a binder can be conducted to obtain a product including a very large amount of effective components.

It is sufficient that the binder may be added in a small amount, 2 to 10% by weight of the bleaching activator composition. To produce a granulation product having an average particle diameter of 0.5 to 1.0 mm, tabletting is preferable. To obtain a granulation product having an average particle diameter of 2 to 3 mm, briquetting is preferable. Flakes molded by compacting can be reduced to fine particles to obtain a compressed granulation product having an average particle diameter of not more than 1 to 2 mm. Formulation of the mold provided on the surface of rollers of briquetting is preferably a pillow mold, lense mold, almond mold, prism mold or wave mold. Any one may be selected properly.

[Bleaching Activator Composition]

The bleaching activator composition of the present invention contains the bleaching activator and the surfactant obtained by the method described above. The content of the bleaching activator in the composition of the present invention is preferably 50 to 95% by weight, more preferably 70 to 90% by weight. The content of the surfactant is preferably 1 to 30% by weight, more preferably 5 to 15% by weight.

The composition of the present invention may be blended with the following additives as other components. These components may be incorporated into the bleaching activator composition during or after manufacturing.

With respect to the stability of the bleaching activator, a solid or powdery acid can be blended. The acid includes, for example, formic acid, succinic acid, maleic acid, fumaric acid, citric acid, glycolic acid, p-hydroxybenzoic acid, phosphoric acid, fatty acid, and zeolite showing acidity in a solid state, among which succinic acid and citric acid are preferable. In this case, the acid may form a salt, and the counterion is an alkali metal ion, ammonium ion, etc. The content of the acid is preferably 0.01 to 20% by weight, more preferably 1 to 15% by weight, even more preferably 1 to 10% by weight, based on the total amount of the composition. In this range, the acid can exhibit excellent performance as a stabilizer of the bleaching activator.

From an aesthetic viewpoint, the composition may be colored by incorporating a pigment or dyestuff. Such coloring agent is preferably Phthalocyanine Green (for example, C. I. Pigments 7, 36, 37, 38 etc.) or Ultramarine Blue (for example, C. I. Pigment Blue 29, etc.) from the viewpoint of shelf stability, and the content of the coloring agent in the bleaching activator composition is 0.01 to 1% by weight, more preferably 0.05 to 0.5% by weight.

As a modifier of the resulting bleaching activator composition, a material having a modifying effect, such as crystalline aluminosilicate (e.g. zeolite), amorphous silica, milled Glauber's salt etc. having a particle diameter of 0.5 to 15 μm, may be blended. The amount of the modifier blended with the bleaching activator composition is 0.5 to 20% by weight, more preferably 1 to 10% by weight.

A perfume may be added to the resulting bleaching activator composition. The perfume includes, but is not limited to, musk-based perfumes, citrus fruit-based perfumes, herb-based perfumes and vegetable-based essential oils. The content thereof in the bleaching activator composition is preferably 0.001 to 5% by weight, more preferably 0.05 to 1% by weight.

As a granulation improver, a water-soluble polymer may also be added. The water-soluble polymer is preferably the one having a water solubility of 60% or more at 20° C., more preferably 80% or more. The molecular weight thereof is preferably 600 or more. The melting point thereof is preferably 20° C. or more. Specific examples of the water-soluble polymer includes polyethylene glycol, polypropylene glycol etc. The molecular weight of polyethylene glycol and polypropylene glycol is preferably 600 to 20000, more preferably 1000 to 10000. The content of the water-soluble polymer in the composition of the present invention is not particularly limited, but is preferably 0.5 to 20% by weight, more preferably 1 to 15% by weight, in order to give a well-granulated product excellent in solubility.

Further, an agent for preventing re-contamination, such as polyvinyl pyrrolidone, and a solubilizer such as urea, urea derivatives, thiourea, p-toluene sulfonate and water-soluble inorganic salts may be added. Magnesium salts such as magnesium sulfate and magnesium silicate known as stabilizers of peroxides or peroxide adducts may also be used.

The size and shape of the bleaching activator composition of the present invention are not particularly limited, but from the viewpoint of solubility and prevention of powdering upon handling, the particle diameter is preferably 125 to 2000 μm, more preferably 125 to 1410 μm. Granules having an increased particle diameter may be recovered after being milled to the particle diameter range described above.

The bleaching activator composition of the present invention is useful, for example, for clothing detergents, and can be used preferably particularly under conditions of washing clothing with low stirring force for a reduced washing time.

EXAMPLES

Next, examples according to the present invention will be explained. These examples are intended to describe preferred embodiments of the present invention but are not intended to be limiting of the invention.

In the Examples, % is based on a weight basis unless otherwise specified.

Example 1

Formula (A)

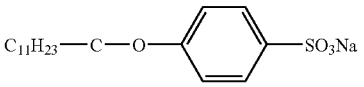

(A)

A 1-L batch kneader (batch kneader PNV-1 manufactured by Irie Shokai Co., Ltd.) was charged with 289.4 g of slurry of a bleaching activator represented by formula (A) above [referred to hereinafter as bleaching activator (A)], dispersed in toluene (effective content 37%), and 11.5 g of 75% of a surfactant (hereinafter referred to as surfactant (B) being a surfactant paste (effective components of 75%) including 75% of C12 to C16 alcohols (C12/C14/C16=67%/28%/5%) and 25% of an ethoxylate (average molecular weight 209) having ethylene oxide in an amount of 1.0 mole on the average added to the above alcohol, was added thereto. The mixture was mixed uniformly for 15 minutes at a revolution number of 60 rpm, and while the mixture was stirred at a revolution number of 60 rpm under passage of hot water at 70° C. through a jacket, the mixing machine was depressurized to a degree of vacuum of 20 kPa (amount of the charged material, 300 g/batch), and under this condition, the toluene and water were removed while stirring for 120 minutes, whereby a dried product was obtained. The resulting dried product was sifted to give a bleaching activator composition having a particle diameter of 125 to 1410 μm.

Example 2

A 2-L beaker was charged with 183 g of bleaching activator (A) and 170 g of toluene, and the mixture was stirred for 10 minutes at 450 rpm with a laboratory stirrer (6-paddle blade ϕ5 cm), and 37 g surfactant (B) was added thereto and dispersed again while stirring with the laboratory stirrer for 10 minutes under the condition described above. 90 g of powdery bleaching activator (A) was previously charged into a 2-L Henschel mixer (Henschel mixer UM2E manufactured by Mitsui Mining Co., Ltd.) and stirred at a revolution number of 750 rpm under passage of hot water at 70° C. through a jacket, while the mixer was depressurized to a degree of vacuum of 11 kPa, the above mixture of the bleaching activator (A) and surfactant (B) was dropped thereto at a rate of 5.0 g/min. and granulated while toluene and water were removed. The resulting granulated product was classified to give a bleaching activator composition having a particle diameter of 125 to 1410 μm.

Example 3

A 2-L beaker was charged with 162 g of the bleaching activator (A) and 156 g of toluene and the mixture was stirred for 10 minutes at 450 rpm with a laboratory stirrer (6-paddle blade ϕ5 cm). 64 g of a surfactant paste (hereinafter called surfactant (c)), obtained by neutralizing a sulfate of a surfactant including C12 to C16 alcohols having a distribution of C12/C14/C16=67%/28%/5%) with an aqueous sodium hydroxide solution, adding 64 g of 75% phosphoric acid as buffer thereto and finely adjusting the mixture with 30.1% aqueous sodium hydroxide solution at pH 10, was added. The mixture was stirred and dispersed again with a laboratory stirrer for 10 minutes under the condition described above. Separately 90 g of the bleaching activator (A) had been fed into a 2-LHenschel mixer (Henschel Mixer UM2E, manufactured by Mitsui Mining Co., Ltd.) and stirred at a revolution number of 750 rpm under passage of hot water at 70° C. through a jacket, while the mixer was adjusted at a vacuum degree of 20 kPa. The above mixture of the bleaching activator (A) and the surfactant (B) was added dropwise thereto at a rate of 10.0 g/min., while toluene and water were removed, to obtain a dry product. The resulting dry product was classified to produce a bleaching activator composition having a particle diameter of 125 to 1410 μm.

Example 4

A mixer (High-Speed Mixer LFS-GS-2J, manufactured by Fukae Powtec Co., Ltd.) was charged with 249.0 g of the dry product obtained in Example 3, 9.0 g of succinic acid (succinic acid manufactured by Kawasaki Kasei Chemicals, called succinic acid), 9.0 g of a nonionic surfactant (Emulgen KS110S95, manufactured by Kao Corporation) and 33.0 g of polyethylene glycol (KPEG6000LA, manufactured by Kao Corporation) in a feed amount of 300 g/Batch. The mixture was stirred under the conditions of the jacket temperature of 75° C., an agitator's rotation number of 350 rpm, a chopper's rotation number of 1850 rpm and mixed until the powder's temperature became 70° C. The product was taken out.

The obtained mixture was then extruded with an extruding granulator (Domegran DG-L1, manufactured by Fuji Paudal Co., Ltd.) through a screen having a hole diameter of 0.7 mm to obtain a compressed product.

The obtained extrusion product was cooled to room temperature and reduced to fine particles with a particle size regulator, Power Mill PS-02S, manufactured by Dalton Co., Ltd. The obtained crushed product was sieved to obtain a bleaching activator composition having a particle diameter of 350 to 1410 μm.

Comparative Example 1

273 g powdery bleaching activator (A) and 27 g dry powder of surfactant (B) were charged into a 2-L Henschel mixer (Henschel mixer UM2E manufactured by Mitsui Mining Co., Ltd.) and granulated while stirring at a revolution number of 750 rpm under passage of hot water of 70° C. through a jacket. The resulting granulated product was classified to give a bleaching activator composition having a particle diameter of 125 to 1410 μm.

Comparative Example 2

210 g of powdery bleaching activator (A), 39 g of a dry powder of surfactant (C), 9.0 g of succinic acid, 9.0 g of E-KS110 and 33.0 g of PEG6000 were fed into a mixer (High Speed Mixer LFS-GS-2J, manufactured by Fukae Powtec Co., Ltd.) in a feed amount of 300 g/Batch. The mixture was stirred under the conditions of the jacket temperature of 75° C., an agitator's rotation number of 350 rpm, a chopper's rotation number of 1850 rpm and mixed until the powder's temperature became 70° C. The product was taken out.

The obtained mixture was then extruded with an extruding granulator (Domegran DG-L1, manufactured by Fuji Paudal Co., Ltd.) through a screen having a hole diameter of 0.7 mm to obtain a compressed product.

The obtained extrusion product was cooled to room temperature and reduced to fine particles with a particle size regulator, Power Mill PS-02S, manufactured by Dalton Co., Ltd. The obtained crushed product was sieved to obtain a bleaching activator composition having a particle diameter of 350 to 1410 μm.

The production conditions in Examples 1 to 4 and Comparative Examples 1 and 2 and the physical properties of the resulting bleaching activator compositions are shown in Table 1. These bleaching activator compositions were evaluated for their solubility (degree of formation of peracid) by the following method. The results are also shown in Table 1.

<Method of Measuring the Degree of Formation of Peracid>

The bleaching activator composition was dissolved in a solution of 0.3 g sodium percarbonate and 0.3 g of anionic surfactant having the following composition in 75 ml tap water such that the amount of the bleaching activator became 1/16 equivalent relative to hydrogen peroxide in the sodium percarbonate, and after the mixture was reacted at 20° C. for 2 minutes and then for 10 minutes, 2.5 mL of 0.3% catalase solution was added thereto, and the mixture was stirred for 1 minute, and 10 mL of 20% sulfuric acid and 10% potassium iodide were added thereto, and the reaction mixture was titrated with 0.1 N sodium thiosulfate to determine the degree of formation of peracid after 2 minutes and after 10 minutes respectively, according to the equation below.

| Anionic surfactant | |
|---|---|
| Sodium linear alkyl (C12 to C13) benzene sulfonate | 25% |
| Sodium alkyl (C14 to C15) sulfate | 8% |
| Sodium carbonate | 20% |
| Glauber's salt | amount adjusted to 100% in total |

Degree (%) of formation of peracid = ({[(amount (mL) of sodium thiosulfate solution titrated/1000) × 0.8]/effective content (g) of bleaching activator}/theoretical effective oxygen amount (mol)) × 100

In Table 1, the term, mixture, is a mixture of a bleaching activator and a surfactant paste.

TABLE 1

| | | Example | | | | Comparative example | |
|---|---|---|---|---|---|---|---|
| | | 1 | 2 | 3 | 4 | 1 | 2 |
| Step 1 | kind of non-aqueous solvent | Toluene | Toluene | Toluene | Toluene | — | — |
| | kind of bleaching activator | Bleaching activator(A) | Bleaching activator(A) | Bleaching activator(A) | Bleaching activator(A) | Bleaching activator(A) | Bleaching activator(A) |
| | Particle diameter of bleaching activator μm | 10 | 8 | 10 | 10 | 10 | 10 |
| | kind of surfactant | Surfactant(B) | Surfactant(B) | Surfactant(C) | Surfactant(C) | Surfactant(B) | Surfactant(C) |
| | State of surfactant | Paste | Paste | Paste | Paste | Powder | Powder |
| | Solid content of bleaching activator paste % | 75 | 75 | 75 | 75 | 100 | 100 |
| | Solid content of mixture % | 38 | 60 | 55 | 55 | — | — |
| | Method of adding mixture | Stimultaneous addition | 5 g/minute | 10 g/minute | 10 g/minute | Powder mixing | Powder mixing |

TABLE 1-continued

| | | Example | | | | Comparative example | |
|---|---|---|---|---|---|---|---|
| | | 1 | 2 | 3 | 4 | 1 | 2 |
| Step 2 | Previously fed powdery material | None | (A) | (A) | (A) | — | — |
| | Jacket temperature ° C. | 70 | 70 | 70 | 70 | — | — |
| | Degree of vacuum kPa | 20 | 11 | 20 | 20 | — | — |
| Granulation process | Jacket temperature of mixture before extrusion ° C. | — | — | — | 75 | — | 75 |
| | Extrusion screen diameter (mm) | — | — | — | 0.7 | — | 0.7 |
| Granulation product composition | Bleaching activator (%) | 93 | 91 | 84 | 70 | 91 | 70 |
| | Surfactant (%) | 7 | 9 | 16 | 13 | 9 | 13 |
| | E-KS-110 (%) | — | — | — | 3 | — | 3 |
| | Succinic acid (%) | — | — | — | 3 | — | 3 |
| | PEG6OOO (%) | — | — | — | 11 | — | 11 |
| Physical property | Particle diameter of granule μm | 125~1410 | 125~1410 | 125~1410 | 350~1410 | 125~1410 | 350~1410 |
| | Bulk density of granule kg/m$^3$ | 780 | 684 | 780 | 600 | 730 | 600 |
| Solubility | Solubility (Degree of formation of peracid after 2 minutes) % | 26 | 40 | 40 | 45 | 17 | 25 |
| | Solubility (Degree of formation of peracid after 10 minutes) % | 61 | 68 | 68 | 70 | 47 | 60 |

The invention claimed is:

1. A process for producing a bleaching activator composition, which comprises removing a solvent and/or water from a mixture of a bleaching activator and a surfactant dispersed in a non-aqueous solvent, wherein said bleaching activator is selected from the group consisting of tetraacetyl ethylene diamine, glucose pentaacetate, tetraacetyl glycoluril, $C_{8-14}$ alkanoyl oxybenzene carboxylic acid or salt thereof, $C_{8-14}$ alkenoyl oxybenzene carboxylic acid or salt thereof, $C_{8-14}$ alkanoyl oxybenzene sulfonate, and $C_{8-14}$ alkenoyl oxybenzene sulfonate, wherein the solvent and/or water is removed while the mixture of the bleaching activator and the surfactant dispersed in the non-aqueous solvent is added to a powdery material in a fluidized state in a mixer, said powdery material comprising the bleaching activator.

2. A process for producing a bleaching activator granule further comprising the step of granulating the bleaching activator composition produced according to the process of claim 1.

3. The process according to claim 1, wherein said bleaching activator dispersed in said non-aqueous solvent is a $C_{10-14}$ alkanoyl oxybenzene carboxylic acid or salt thereof.

4. The process according to claim 1, wherein said bleaching activator dispersed in said non-aqueous solvent is a $C_{10-14}$ alkenoyl oxybenzene carboxylic acid or salt thereof.

5. The process according to claim 1, wherein said bleaching activator dispersed in said non-aqueous solvent is a $C_{10-14}$ alkanoyl oxybenzene sulfonate.

6. The process according to claim 1, wherein said bleaching activator dispersed in said non-aqueous solvent is a $C_{10-14}$ alkenoyl oxybenzene sulfonate.

7. The process according to claim 1, wherein said bleaching activator dispersed in said non-aqueous solvent is decanoyl oxybenzene carboxylic acid or salt thereof.

8. The process according to claim 7, wherein said bleaching activator dispersed in said non-aqueous solvent is a sodium salt.

9. The process according to claim 1, wherein said bleaching activator dispersed in said non-aqueous solvent is a dodecanoyl oxybenzene sulfonate.

10. The process according to claim 1, wherein said non-aqueous solvent is selected from the group consisting of hydrocarbons, ketones, alcohols, and ethers.

11. The process according to claim 1, wherein said non-aqueous solvent is selected from the group consisting of toluene, xylene, benzene, hexane, octane, acetone, ethyl alcohol, isopropyl alcohol, and diethyl ether.

12. A process for producing a bleaching activator composition, which comprises removing a solvent and/or water from a mixture of a bleaching activator and a surfactant dispersed in a non-aqueous solvent, wherein said bleaching activator is sodium dodecanoyl oxybenzene sulfonate, wherein the solvent and/or water is removed while the mixture of the bleaching activator and the surfactant dispersed in the non-aqueous solvent is added to a powdery mixture in a fluidized state in a mixer, said powdery material comprising the bleaching activator.

* * * * *